United States Patent [19]

Loomis

[11] Patent Number: 4,800,947

[45] Date of Patent: Jan. 31, 1989

[54] TENSION MOUNTING SYSTEM AND ASSEMBLY

[75] Inventor: Russell M. Loomis, Palos Heights, Ill.

[73] Assignee: Joseph K. Favata, Cicero, Ill.

[21] Appl. No.: 99,056

[22] Filed: Sep. 21, 1987

[51] Int. Cl.[4] ..... E06B 3/00

[52] U.S. Cl. ..... 160/368.1; 160/378; 38/102.91; 248/231.4; 248/488

[58] Field of Search ..... 160/368 R, 378, 375; 38/102.91, 102.1; 248/231.4, 231.1, 488

[56] References Cited

U.S. PATENT DOCUMENTS

| | | | |
|---|---|---|---|
| 2,212,313 | 8/1940 | Avenson . | |
| 2,218,451 | 10/1940 | Heyne | 160/378 X |
| 2,533,565 | 12/1950 | Eichelman . | |
| 3,591,940 | 7/1971 | Siemmons . | |
| 3,758,972 | 9/1973 | Egermayer . | |
| 3,830,278 | 8/1974 | Packer . | |
| 3,968,528 | 7/1976 | Poerink | 160/378 X |
| 4,041,861 | 8/1977 | Alter | 38/102.91 X |
| 4,233,765 | 11/1980 | O'Mullan et al. . | |
| 4,265,039 | 5/1981 | Brooks . | |
| 4,317,302 | 3/1982 | Von De Linde . | |
| 4,372,071 | 2/1983 | Vicino . | |
| 4,452,000 | 6/1984 | Gandy . | |
| 4,657,062 | 4/1987 | Tuerk . | |

*Primary Examiner*—Ramon S. Britts
*Assistant Examiner*—Blair M. Johnson
*Attorney, Agent, or Firm*—Thomas W. Speckman; Ann W. Speckman

[57] ABSTRACT

A tension mounting system and assembly for suspending a flexible sheet material in a taut condition from a generally planar support surface and providing selective tension adjustment of the flexible sheet material is provided. The mounting system and assembly is especially suitable for use in signs displaying advertising material, such as billboards, signboards, and the like.

19 Claims, 2 Drawing Sheets

FIG. 4
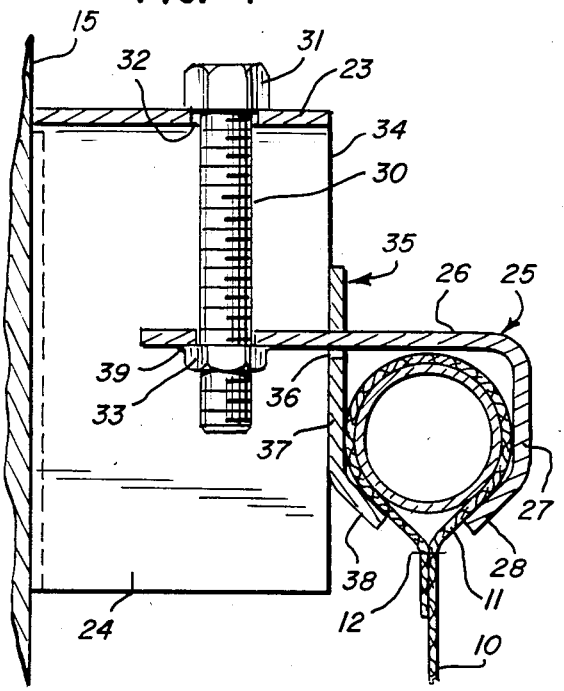
FIG. 5
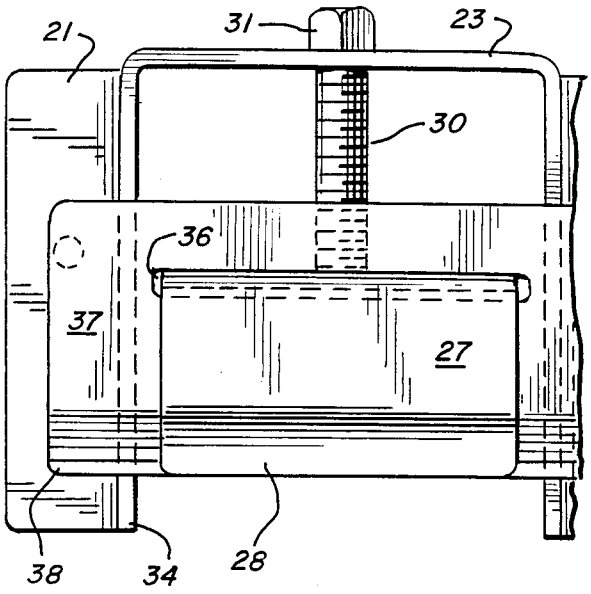
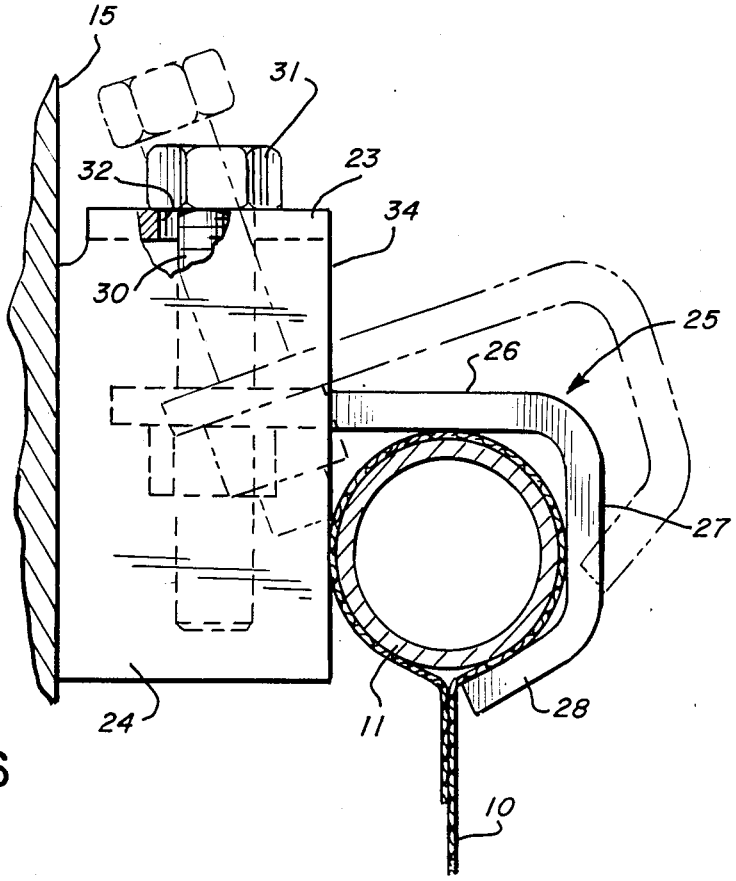
FIG. 6

TENSION MOUNTING SYSTEM AND ASSEMBLY

BACKGROUND OF THE INVENTION

1. Field of the Invention

The present invention relates to a tension mounting system and assembly whereby a flexible sheet material may be suspended in a taut condition from a generally planar support surface. The mounting system and assembly of the present invention is particularly suitable for use in signs displaying advertising material, such as billboards, signboards, and the like.

2. Description of the Prior Art

Display signs have been used for a variety of purposes and in a variety of applications, typically for promoting a business or a product. Conventional billboards generally comprise a planar rigid support surface, or a plurality of such surfaces mounted adjacent one another, upon which the advertising message is painted. Alternatively, the advertising material may be painted or printed on paper or another sheet-like material which is then affixed to the planar rigid support surface, typically by means of adhesives. In many cases, the billboard comprises a freestanding structure mounted on the ground or on a building or the like, and it may be illuminated by spotlights, or the like, to provide visibility during the nighttime. In some cases, advertising material is applied directly to the surfaces of a building structure itself because the building structure cannot support the weight of a billboard support structure. These types of conventional billboards are very expensive to erect and maintain because preparation and maintenance, in particular, are labor intensive operations. The appearance of conventional billboards is also apt to deteriorate rapidly due to weather conditions such as sun, precipitation, changes in temperature, and the like.

Signs comprising a substantially rigid sheet of transparent or translucent material upon which an advertising message has been applied have also been utilized, generally by mounting them in a cabinet and illuminating the sheet material bearing the advertising message from inside the cabinet. These types of display signs generally exhibit less deterioration due to weather conditions, but the size of the display sign is quite limited, since transport and installation of a large, substantially rigid sheet is impracticable. In addition, these materials exhibit at least some resiliency, which limits the practical dimensions of the sign, and tends to result in distortion or bowing of the sign due to the weight of the material and due to adverse weather conditions, such as high winds.

Recent innovations in the advertising industry include the use of a flexible, fabric-like sheet material which is light, relatively impervious to weather, and may be illuminated from behind to provide an attractive and effective display. This material is preferably suspended in a taut condition to provide a planar display surface. The costs associated with installation and maintenance of display signs comprising a flexible sheet material are generally less than those associated with conventional signboards and billboards, since the advertising message may be applied at a central location, and the sheet material may be rolled or folded for convenient transport to the display location. The flexible fabric-like sheet material may be applied over or suspended from a conventional billboard support surface or a building support structure.

Means for mounting and/or framing flexible paper and synthetic sheet-like materials are known to the art. U.S. Pat. No. 2,212,313 teaches a display panel wherein a flexible, replaceable cover is mounted to a rigid rail at each longitudinal edge, and the longitudinal edges are wrapped around upright tubular structures and anchored to cross members by means of springs. U.S. Pat. No. 2,533,565 teaches a display frame for retaining a flexible display panel in a taut condition generally parallel to a backing board by means of spring clips along one edge and rigid clips along the opposite edge. U.S. Pat. No. 3,591,940 teaches a supporting frame for releasably clamping flexible sheet materials, such as posters, to the frame means. The poster is fastenable to opposite frame members by clamp means and a spring may be wedged between the frame members to provide the desired tension. U.S. Pat. No. 3,758,972 teaches a sign housing with a removably mounted sign panel wherein the edges of the sign sheet and a protective cover sheet are retained between nesting members of the panel frame. U.S. Pat. No. 3,830,278 teaches a modular canvas stretcher wherein canvas is fastened to the stretcher frame comprising rigid, mitered elongated members having longitudinal channels for retaining bracket members and bracing members. U.S. Pat. No. 4,233,765 teaches a peripheral framework for suspending flexible sheet materials over a central open area. The peripheral framework is provided with a channel for receiving a flexible strip member, by which the flexible material is engaged between the channel and the strip member.

U.S. Pat. No. 4,317,302 teaches a sign cabinet for outdoor signs comprising a support frame with clamp assemblies for retaining a flexible sign face under tension. U.S. Pat. No. 4,452,000 teaches an illuminatable sign and framework housing therefor, wherein a sheet of flexible, light-transmitting material extends across and covers an opening, and bolts secure a peripheral marginal portion of the sheet by adjustably tensioning the sheet across the opening. U.S. Pat. No. 4,372,071 teaches a fabric faced billboard wherein air pressure is applied from behind the-fabric to smooth the fabric and provide a continuous, slightly curved display face.

U.S. Pat. No. 4,265,039 teaches a framework for suspending a fabric display face and a clamp assembly for selective adjustment of fabric tension. The U.S. Pat. No. 4,265,039 teaches that prior art clamp assemblies required spaced holes to be punched in the fabric display through which bolts of the clamp assemblies were passed. The clamp assemblies were tightened around the fabric by means of a first nut, and the fabric was then tensioned by means of a second nut drawing the suspended clamp toward the mounted bracket. This system is undesirable from the standpoint that a plurality of holes are required in the fabric sign at prescribed intervals, and the fabric sign is prone to tearing during installation. In addition, multiple adjustments of the multiplicity of clamp assemblies to first tighten the clamp assembly around the fabric, and second tension the fabric, is tedious and time consuming. The U.S. Pat. No. 4,265,039 teaches a fastening assembly having upper and lower support elements joined between corresponding opposite ends by respective side support elements. A hinge element is affixed to at least one of the support elements, and a hinge pin to which a marginal portion of the fabric is coupled may undergo limited rotation in conjunction with the hinge element to provide selective adjustment of the tension induced in the fabric.

U.S. Pat. No. 4,657,062 teaches an adjustable clamping system for tensioning and locking a flexible tarp. The U.S. Pat. No. 4,657,062 teaches a roll bar for fastening an edge of the flexible tarp to the clamping means. Roll bars of this type having a groove for retaining an enlarged or supported edge of the flexible tarp may be used in the practice of the present invention.

It is evident from the above recitation of prior art patents that the use of flexible sheet materials for outdoor displays and signboards is known, and that a variety of support structures and tensioning mechanisms has been proposed. None of the prior art systems, however, provides satisfactory and selective tensioning of the flexible sheet-like material in combination with a simplified and convenient assembly technique.

SUMMARY OF THE INVENTION

It is an objective of the present invention to provide a simplified tension mounting system and assembly wherein a flexible, sheet-like material may be suspended in a taut condition from a generally planar support surface and selectively tensioned by a plurality of bracket means which are fastenable to existing billboard structures, building support structures such as walls and roofs, and the like.

It is another objective of the present invention to provide a tension mounting system and assembly which facilitates installation and removal of flexible, sheet-like materials without requiring disassembly of mounting brackets.

It is still another objective of the present invention to provide clamping and selective tension adjustment of the flexible, sheet-like material by means of a single adjustment mechanism on each of a plurality of bracket means.

It is yet another objective of the present invention to provide a tension mounting system and assembly for suspending a flexible sheet material in a taut condition which is versatile and may be adapted to a variety of sign sizes, weights and designs.

The tension mounting assembly of the present invention comprises a flexible, sheet-like material with a rigid retaining means extending around at least a portion of its peripheral edges, and a plurality of bracket means fastened to a generally planar support surface and arranged along at least two opposite edges of the flexible, sheet-like material, each bracket means adapted to clamp the retaining means and provide selective tensioning of the flexible sheet-like material by means of a single adjustment mechanism. The tension mounting system and assembly of the present invention is especially preferred for use in display signs and billboards for exhibiting an advertising message, but may also be used in any application where suspension of a flexible sheet material in a taut condition is desired.

BRIEF DESCRIPTION OF THE DRAWINGS

Further features of the present invention will be apparent from the following more detailed description of the invention read in conjunction with the drawings, wherein:

FIG. 4 shows an enlarged cross-sectional side view of another embodiment of a bracket means suitable for use in the tension mounting assembly of the present invention;

FIG. 5 shows a front view of the bracket means shown in FIG. 4; and

FIG. 6 shows a side view of the bracket means shown in FIG. 2 illustrating, in dashed lines, adjustment of the bracket arm during installation.

DESCRIPTION OF PREFERRED EMBODIMENTS

Figure 1:
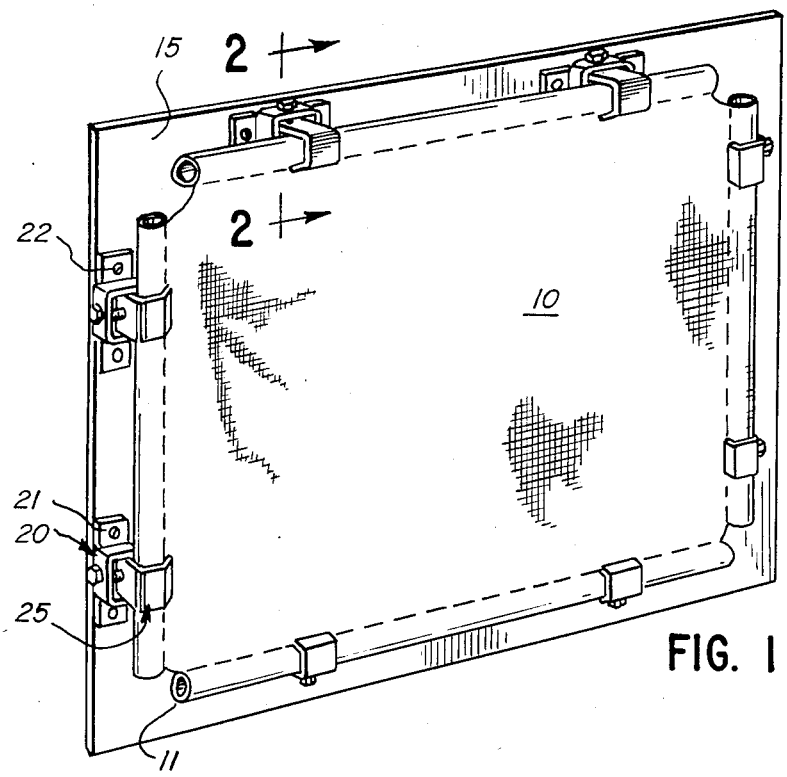
Fig. 1 shows a perspective view of the tension mounting of the present invention.

As shown in FIG. 1, the tension mounting system and assembly of the present invention comprises flexible sheet material 10 provided with rigid retaining means 11 along its peripheral edges, and a plurality of bracket means 20 fastened to support surface 15 and spaced at intervals along at least two opposite peripheral edges of flexible sheet 10. Flexible sheet material 10 may comprise any flexible, fabric-like material, and preferably comprises a fabric-like sheet material reinforced to provide strength and durability. Synthetic materials and multilaminates which are weather-resistant are especially preferred, and suitable materials are well known to the art. Suitable means for applying an advertising message to the surface of flexible sheet 10, such as by painting, printing, silk screening, and the like, are also well known to the art.

At least a portion of the peripheral edges of flexible sheet 10 are mounted on rigid retaining means 11. According to the illustrated embodiments, a peripheral edge of flexible sheet material 10 forms a loop with the edge of flexible sheet 10 fastened to the front face of flexible sheet 10 at attachment point 12 by stitching, adhesives, or other fastening means known to the art. Rigid retaining means 11 are insertable in the loops thus formed at the peripheral edges of flexible sheet 10. Flexible sheet material 10 may be mounted on rigid retaining means 11 by other fastening means, such as adhesives, but the embodiment illustrated in the drawings is preferred for most applications.

Rigid retaining means 11 preferably comprise a lightweight metallic or rigid plastic material, and may be in the form of a tube or bar, or may have any cross-sectional configuration which is convenient for a particular application. Rigid retaining means 11 are preferably hollow, as shown, to reduce the weight of the assembly. Rigid retaining means 11 may be mounted at the peripheral, edges of flexible sheet 10 at the assembly site to facilitate transport of the components to the site. Rigid retaining means 11 are preferably mounted at least at two opposing peripheral edges of flexible sheet 10 and are most preferably mounted along each peripheral edge of flexible sheet 10. Rigid retaining means 11 may be provided along the length of a peripheral edge, or rigid retaining means 11 may be provided in shorter lengths, and mounted at intervals along the peripheral edges of flexible sheet 10. Provision of a separate but continuous rigid retaining means 11 along the length of each peripheral edge of flexible sheet material 10 is preferred.

As shown in the perspective view of FIG. 1, a plurality of bracket means 20 are affixed to a generally planar support surface 15 for suspending flexible sheet 10 generally parallel to planar support surface 15, and for selectively tensioning flexible sheet 10. Each bracket means 20 preferably comprises at least two flanges 21 disposed on opposite sides of the bracket from one another for attachment to support surface 15. One or more bores are provided in each attachment flange 21 for receiving fasteners 22, and different types of fasteners 22 may be utilized, depending upon the composition of support surface 15. For example, support surface 15 may comprise all or a portion of an existing wooden or metallic billboard structure, or planar support surface 15 may be a building structure surface comprising wood, brick, cement,-metal, or the like. Suitable fasteners 22 for attachment of bracket means 20 to support surface 15 are known to the art.

Bracket means 20 further comprises top wall 23 oriented in a plane substantially perpendicular to attachment flanges 21, and side walls 24 extending substantially perpendicular to top wall 23 and attachment flanges 21. Side walls 24 are preferably continuous with or rigidly fixed to attachment flanges 21 at one edge, while the opposite terminal edges 34 of side walls 24 form a clamp in combination with adjustable bracket arm 25. Top wall 23 is preferably continuous with or rigidly fixed to side walls 24. It is to be understood that the designation of top wall 23 does not necessarily indicate orientation of the wall with respect to the ground, since bracket means 20 may be mounted on support surface 15 in a variety of orientations and, for example, bracket means 20 mounted at opposite peripheral edges of flexible sheet 10 are mounted at an orientation rotated 180° from the opposite bracket means.

Figure 2:
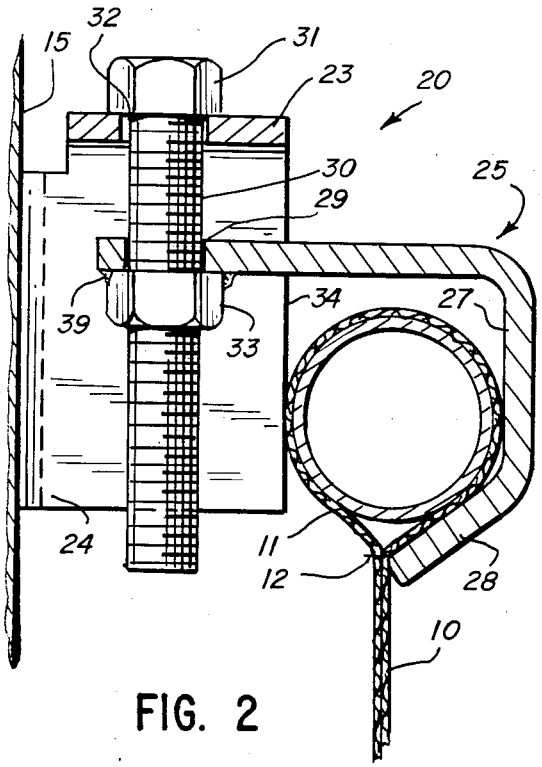
Fig. 2 shows an enlarged cross-sectional side view of the flexible sheet material suspended from a bracket means taken through line 2—2 of FIG. 1.
Figure 3:
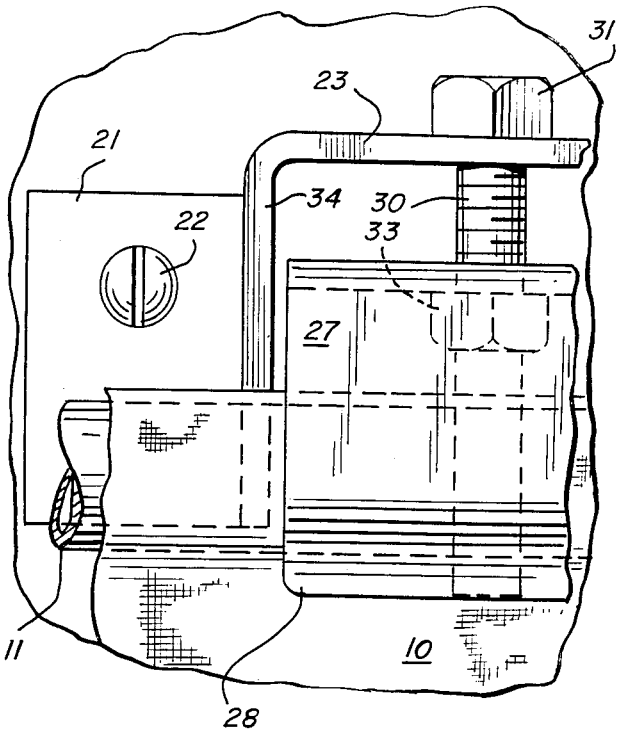
FIG. 3 shows an enlarged front view of the bracket means 2.

Threaded adjustment means 30 penetrates bore 32 in top wall 23, and also penetrates bore 29 in adjustable bracket arm 25. Bore 32 in top wall 23 is preferably located centrally with respect to side walls 24, and is preferably larger in diameter than threaded adjustment means 30 and smaller in diameter than head 31 at one terminal end of threaded adjustment means 30, as shown in FIG. 2. Threaded adjustment means 30 attached to adjustable bracket arm 25 is thus pivotable with respect to the central longitudinal axis of bore 32, as illustrated in FIG. 6, to facilitate insertion of rigid retaining means 11 in adjustable bracket arm 25.

Adjustable bracket arm 25 preferably comprises first leg 26 having bore 29 for receiving threaded adjustment means 30, first leg 26 extending beyond terminal edges 34 of side walls 24 and continuous with or rigidly fixed to second leg 27. Second leg 27 is preferably oriented generally perpendicular to first leg 26 and generally parallel to attachment flanges 21 and is continuous with or rigidly attached to first leg 26 and third leg 28. The inner surface of third leg 28 is preferably at an angle of from about 110° to about 135° with respect to the inner surface of second leg 27. Third leg 28 extends for less than the distance between terminal edges 34 of side walls 24 and second leg 27 to provide access for insertion and clamping of rigid retaining means 11 within adjustable bracket arm 25.

Nut 33 may be rigidly attached, such as by welds 39, to first leg 26 of adjustable bracket arm 25 and aligned with bore 29. Nut 33 is internally threaded to match the external threads on threaded adjustment means 30, and threaded adjustment means 30 is thereby threadedly engageable on fixed nut 33. Alternatively, bore 29 in first leg 26 of adjustable bracket arm 25 may be provided with internal threads matching the external threads on threaded adjustment means 30 so that threaded adjustment means 30 is threadedly engageable in bore 29. As threaded adjustment means 30 is rotated in one direction, adjustable bracket arm 25 is axially displaced toward top wall 23 and, conversely, as threaded adjustment means 30 is rotated in the opposite direction, adjustable bracket arm 25 is axially displaced away from top wall 23.

When bore 32 in top wall 23 has a larger diameter than threaded adjustment means 30, threaded adjustment means 30 is pivotable with respect to the central longitudinal axis of bore 32, thereby enlarging the gap between the terminal end of third leg 28 and the terminal edges 34 of side walls 24, and permitting rigid retaining means 11 to be introduced-into adjustable bracket arm 25. Threaded adjustment means 30 may then be rotated to axially displace adjustable bracket arm 25 toward top wall 23, thereby clamping rigid retaining means 11 between the inner surfaces of adjustable bracket arm 25 and terminal edges 34 of side walls 24. Additional rotation of threaded adjustment means 30 will result in axial displacement of adjustable bracket arm 25 and rigid retaining means 11 toward top wall 23, thereby tensioning flexible sheet 10.

FIGS. 4 and 5 show another embodiment of bracket means 20 of the present invention. As shown in FIG. 4, bracket means 20 may additionally comprise inner bracket arm 35 having first component 37 oriented substantially parallel to second leg 27 of adjustable bracket arm 25, and second component 38 provided at substantially the same angle with respect to first component 37 as third leg 28 is to second leg 27 of adjustable bracket arm 25. Inner bracket arm 35 may be rigidly attached to adjustable bracket arm 25, but is preferably adjustably mounted on adjustable bracket arm 25 by means of slot 36 receiving first leg 26 of adjustable bracket means 25, as shown in FIGS. 4 and 5. Provision of slot 36 permits threaded adjustment means 30 to pivot with respect to the central longitudinal axis of bore 32, thereby enlarging the gap between the terminal ends of adjustable bracket arm 25 and inner bracket arm 35 and permitting rigid retaining means 11 to be inserted between adjustable bracket arm 25 and inner bracket arm 35. Rotation of threaded adjustment means 30 causes axial displacement of adjustable bracket arm 25, inner bracket arm 35 and threaded nut 33 along the central longitudinal axis of bore 32.

FIG. 5 illustrates a preferred embodiment of the bracket means shown in FIG. 4 wherein first component 37 and second component 38 of inner bracket arm 35 are wider than the corresponding walls of adjustable bracket arm 25 and top wall 23, and first component 37 abuts terminal edges 34 of side walls 24. This embodiment of bracket means 20 prevents friction from occurring due to contact of flexible sheet 10 with terminal edges 34 of side walls 24, since flexible sheet 10 contacts only smooth,.continuous surfaces of adjustable bracket arm 25 and inner bracket arm 35. Insertion of rigid retaining means 11 in bracket means 20, and tensioning of flexible sheet 10 may thus be achieved without causing rubbing or clamping friction at an point on flexible sheet 10.

The tension mounting system of the present invention operates as follows to provide suspension and selective tensioning of sheet material 10. Sheet material 10 is provided as desired with suitable advertising material, or the like, and is provided with suitable means for attachment of rigid retaining means 11 at a remote location and conveniently transported to the assembly site. Likewise, a plurality of rigid retaining means 11 and bracket means 20 may also be conveniently transported to the assembly site.

A plurality of bracket means 20 are provided for suspending and selectively tensioning flexible sheet material 10 at least at two opposite peripheral edges of flexible sheet material 10. For example, bracket means 20 may be provided only along the top and bottom peripheral edges of flexible sheet 10, or bracket means 20 may be provided only at the side peripheral edges of flexible sheet 10. For most applications, and particularly those in which flexible sheet 10 comprises a relatively large surface area, bracket means 20 are preferably provided at intervals along each peripheral edge of flexible sheet 10. At least two bracket means 20 are preferably provided at each peripheral edge, and additional bracket means may be provided where the surface area and/or weight of flexible sheet 10 requires additional support.

Bracket means 20 are mounted on support surface 15 at appropriate intervals in accordance with the dimensions of flexible sheet 10. Rigid retaining means 11 may be mounted at the peripheral edges of flexible sheet 10 at the assembly site, and insertion of rigid retaining means 11 into adjustable bracket arm 25 of each bracket means 20 may be achieved by sequentially pivoting each adjustable bracket arm 25 and rotating threaded adjustment means 30 to axially displace adjustable bracket arm 25 sufficiently to clamp rigid retaining means 11 between the inner surfaces of adjustable bracket arm 25 and terminal edges 34 of side walls 24 of bracket means 20. Rigid retaining means 11 may be sequentially clamped within the adjustable bracket arm of each bracket means 20 in this fashion. Flexible sheet 10 is then suspended, and selective tensioning may be provided by further rotation of threaded adjustment means 30 at appropriate bracket means 20, as necessary, to provide flexible sheet 10 in a taut and wrinkle-free condition.

Assembly and disassembly of the tension mounting system of the present invention may be achieved by a single person in a very short period of time. Assembly and disassembly of this tension mounting system does not require any specialized tools or skills, and suspension and removal of flexible sheets 10 may be achieved without disassembly of the mounting brackets. The tension mounting system of the present invention is suitable for outdoor and indoor use. The flexible sheet may be illuminated from behind by lights mounted on the support surface, since the configuration and dimensions of the bracket means may be varied to suspend the flexible sheet at any predetermined distance from the support surface. A decorative framework may be mounted from the exterior legs of the adjustable bracket arms of the bracket means for cosmetic purposes if desired.

While in the foregoing specification this invention has been described in relation to certain preferred embodiments thereof, and many details have been-set forth for the purposes of illustration, it will be apparent to those skilled in the art that the invention is susceptible to additional embodiments and that certain of the details described herein may be varied considerably without departing from the basic principles of the invention.

I claim:

1. A tension mounting assembly for suspending flexible sheet material in a taut condition comprising:

a flexible sheet;

at least two rigid retaining means mounted at least at two opposite peripheral edges of said flexible sheet; and at least two bracket means attachable to a support surface at locations corresponding to said at least two opposite peripheral edges of said flexible sheets, each said bracket means comprising at least one attachment flange attachable to said support surface, two side walls rigidly attached and oriented generally perpendicular to said attachment flange, a top wall oriented substantially perpendicular to said side walls and said attachment flange, an adjustable bracket arm adjustably clamping said rigid retaining means between said side walls and said adjustable bracket arms, and a threaded adjustment means engaging said top wall of said bracket means and said adjustable bracket whereby rotation of said threaded adjustment means causes axial displacement of said adjustable bracket arm and said rigid retaining means capable of tautening said flexible sheet.

2. A tension mounting assembly for suspending flexible sheet material in a taut condition according to claim 1 wherein said flexible sheet is provided with closed loops said at least at two opposite peripheral edges for mounting said rigid retaining means.

3. A tension mounting assembly for suspending flexible sheet material in a taut condition according to claim 2 wherein said rigid retaining means comprise tubes mounted in said closed loops.

4. A tension mounting assembly for suspending flexible sheet material in a taut condition according to claim 3 wherein said rigid retaining means extend along substantially the entire length of at least said two opposite peripheral edges of said flexible sheet.

5. A tension mounting assembly for suspending flexible sheet material in a taut condition according to claim 1 wherein said flexible sheet is generally rectangular and has rigid retaining means mounted at all peripheral edges, and a plurality of bracket means are attached to said support surface at locations corresponding to all said peripheral edges of said flexible sheet.

6. A tension mounting assembly for suspending flexible sheet material in a taut condition according to claim 5 wherein at least two bracket means are attached to said generally planar support surface at locations corresponding to each said peripheral edge of said flexible sheet.

7. A tension mounting assembly for suspending flexible sheet material in a taut condition according to claim 1 wherein each said bracket means comprises at least two attachment flanges and a top wall rigidly attached to said side walls.

8. A tension mounting assembly for suspending flexible sheet material in a taut condition according to claim 7 having a bore in said top wall spaced substantially centrally between said side walls through which said threaded adjustment means extends.

9. A tension mounting assembly for suspending flexible sheet material in a taut condition according to claim 8 wherein said bore in said top wall is larger in diameter than the diameter of said threaded adjustment means and said threaded adjustment means is pivotable with respect to a central longitudinal axis of said bore in said top wall.

10. A tension mounting assembly for suspending flexible sheet material in a taut condition comprising:

a flexible sheet;

at least two rigid retaining means mounted at least at two opposite peripheral edges of said flexible sheet; and at least two bracket means attachable to a support surface at locations corresponding to said at least two opposite peripheral edges of said flexible sheet, each said bracket means comprising at least two attachment flanges attachable to said support surface, two side walls rigidly attached and oriented generally perpendicular to said attachment flanges, a top wall rigidly attached to said side walls and oriented substantially perpendicular to said side walls and said attachment flanges; an adjustable bracket arm comprising a first leg oriented generally parallel to said top wall, a second leg rigidly attached and oriented generally perpendicular to said first leg, and a third leg rigidly attached and oriented at an angle of about 110° to about 135° to said second leg adjustably clamping said rigid retaining means; and a threaded adjustment means engaging said top wall of said bracket means and said adjustable bracket arm whereby rotation of said threaded adjustment means causes axial displacement of said adjustable bracket arm and said rigid retaining means capable of tautening said flexible sheet.

11. A tension mounting assembly for suspending flexible sheet material in a taut condition according to claim 10 wherein each said bracket means additionally comprises an inner bracket arm having a first component oriented substantially parallel to said second leg of said adjustable bracket arm and a second component rigidly attached and oriented at an angle of about 110° to about 135° to said first component.

12. A tension mounting assembly for suspending flexible sheet material in a taut condition according to claim 11 wherein said first and second components of said inner bracket arm are wider than the distance between said two side walls of said bracket means and said first component has a slot receiving said first leg of said adjustable bracket arm.

13. A tension mounting assembly for suspending flexible sheet material in a taut condition comprising:

a flexible sheet;

at least two rigid retaining means mountable at least at two opposite peripheral edges of said flexible sheet; and a plurality of bracket means attachable to a support surface at locations corresponding to said at least two opposite peripheral edges of said flexible sheet, each said bracket means comprising at least one attachment flange attachable to said support surface, a heavy beam surface, a top wall oriented substantially perpendicular to said attachment flange, and an adjustable bracket arm clamping said rigid retaining means between said adjustable bracket arm and said bearing surface, and being threadedly engaged with a threaded adjustment means retained in a bore in said top wall of said bracket means, whereby rotation of said threaded adjustment means causes axial displacement of said adjustable bracket arm capable of tautening said flexible sheet.

14. An adjustable bracket means comprising:

at least two attachment flanges, at least two side walls rigidly attached and oriented generally perpendicular to said at least two attachment flanges, and a top wall rigidly attached to said side walls and oriented generally perpendicular to said side walls and said attachment flanges, said top wall provided with a bore spaced centrally between said side walls;

a threaded adjustment means having an enlarged head at one terminal end, said threaded adjustment means extending through said bore in said top wall and retained in said bore by said enlarged head;

an adjustable bracket arm threadedly engaged on said threaded adjustment means, said adjustable bracket arm having a first leg oriented generally parallel to said top wall, a second leg rigidly attached and oriented generally perpendicular to said first leg, and a third leg rigidly attached and oriented at an angle of about 110° to about 135° to said second leg, whereby rotation of said threaded adjustment means causes axial displacement of said adjustable bracket arm.

15. An adjustable bracket means according to claim 14 wherein said bore in said top wall has a diameter larger than said threaded adjustment means and smaller than said enlarged head, and said threaded adjustment means is pivotable with respect to the central longitudinal axis of said bore in said top wall.

16. An adjustable bracket means according to claim 14 wherein said adjustable bracket arm additionally comprises an internally threaded nut fixedly attached to said first leg of said adjustable bracket arm and threadedly engaged with said threaded adjustment means.

17. An adjustable bracket means according to claim 14 additionally comprising an inner bracket arm adjustably retained on said adjustable bracket arm, said inner bracket arm comprising a first component oriented substantially parallel to said second leg of said adjustable bracket arm and laterally displaced therefrom, and a second component extending at an angle of about 110° to about 135° from said first component, said second component of said inner bracket arm extending in a direction toward said third leg of said adjustable bracket arm.

18. An adjustable bracket means according to claim 17 wherein said first and second components of said inner bracket arm are wider than the distance between said side walls and said first component of said inner bracket arm abuts the terminal edges of said side walls.

19. An adjustable bracket means according to claim 18 wherein said first component of said inner bracket arm has a slot receiving said first leg of said adjustable bracket arm.

* * * * *